US010137586B1

(12) United States Patent
Strong

(10) Patent No.: US 10,137,586 B1
(45) Date of Patent: Nov. 27, 2018

(54) DUAL STROKE RAZOR SYSTEM

(71) Applicant: Jean E. Strong, Clearwater, FL (US)

(72) Inventor: Jean E. Strong, Clearwater, FL (US)

( * ) Notice: Subject to any disclaimer, the term of this patent is extended or adjusted under 35 U.S.C. 154(b) by 0 days.

(21) Appl. No.: 15/392,492

(22) Filed: Dec. 28, 2016

(51) Int. Cl.
*B26B 21/52* (2006.01)
*B26B 21/06* (2006.01)
*B26B 21/08* (2006.01)

(52) U.S. Cl.
CPC ..... *B26B 21/527* (2013.01); *B26B 21/06* (2013.01); *B26B 21/08* (2013.01); *B26B 21/525* (2013.01)

(58) Field of Classification Search
CPC ..... B26B 21/527
USPC ..... 30/34.1, 47–51, 526–536, 298; D8/98; D28/44–48
See application file for complete search history.

(56) References Cited

U.S. PATENT DOCUMENTS 106,436 A * 8/1870 Welch ..... A47J 17/02 30/298
211,345 A * 1/1879 Price ..... A47J 17/02 30/298
224,975 A * 2/1880 White ..... A01D 46/247 30/298
443,178 A * 12/1890 Jordan ..... B26B 27/007 30/298
773,782 A * 11/1904 Brown, Jr. ..... B26B 27/007 30/298
851,341 A * 4/1907 Bullard ..... B26B 21/18 30/526
861,422 A * 7/1907 Astorgis ..... B26B 21/16 30/526
890,350 A * 6/1908 Fowler ..... B26B 21/16 30/526
971,772 A * 10/1910 Millar ..... B26B 21/14 30/526
1,031,772 A * 7/1912 Caldwell ..... B26B 27/007 30/298
D42,940 S * 8/1912 Hiener ..... D28/46
1,058,082 A * 4/1913 Moore ..... B26B 21/18 30/526
1,088,873 A * 3/1914 Boyler ..... B26B 21/16 30/526
1,200,427 A * 10/1916 Lishawa ..... B26B 21/18 30/534

(Continued)

FOREIGN PATENT DOCUMENTS

FR 2636558 A1 * 3/1990 ..... B25G 1/102
FR 2942737 B1 * 6/2014 ..... B26B 21/527

(Continued)

*Primary Examiner* — Jason Daniel Prone

(57) ABSTRACT

A base has a top, a bottom, a left side, a right side, an upper section, a lower section, a left lateral section extending outwardly and upwardly from the lower section, a right lateral section extending outwardly and upwardly from the lower section, a left surface along the left side section and the left lateral section, and a right surface along the right side section and the right lateral section. The left surface and the right surfaces are each in a generally semi-cylindrical configuration and together form a primary gripping assembly. A head with an operational face faces away from the base. The operational face includes at least one left blade and at least one right blade and an arcuate sliding surface there between.

3 Claims, 3 Drawing Sheets

(56) References Cited

U.S. PATENT DOCUMENTS 1,201,317 A * 10/1916 King ..... B26B 21/527 30/526
1,460,139 A * 6/1923 Parker ..... B26B 21/16 30/526
1,471,114 A * 10/1923 Everts ..... B26B 21/16 30/526
1,515,923 A * 11/1924 Berntson et al. ..... A47J 17/02 30/298
1,520,604 A * 12/1924 Sexauer ..... B26B 21/18 30/534
1,642,311 A * 9/1927 Richardson ..... A01D 46/247 30/298
D82,453 S * 11/1930 Scully ..... D28/46
1,785,917 A * 12/1930 Schuster ..... B26B 21/38 30/526
1,875,990 A * 9/1932 Christmas ..... B26B 21/523 30/526
1,876,570 A * 9/1932 Cesario ..... B26B 21/00 30/526
1,917,812 A * 7/1933 Robinson ..... B26B 21/527 30/534
2,020,043 A * 11/1935 Taylor ..... B26B 21/32 30/526
2,102,142 A * 12/1937 Burnett ..... B26B 21/18 30/526
2,155,749 A * 4/1939 Young et al. ..... B26B 21/18 30/526
D118,833 S * 2/1940 Pierson ..... D28/46
2,259,474 A * 10/1941 Jones ..... B26B 21/16 30/526
2,286,553 A * 6/1942 Krigbaum ..... B26B 21/32 30/527
D136,508 S * 10/1943 McLeod ..... D28/46
D142,175 S * 8/1945 Shipley ..... D28/48
D146,759 S * 5/1947 Brown ..... D28/46
2,534,861 A * 12/1950 Foltis ..... B26B 21/06 30/526
D162,933 S * 4/1951 Chambers ..... D28/46
D169,147 S * 3/1953 Lamb ..... 30/526
2,750,663 A * 6/1956 Coles ..... B26B 21/08 30/84
2,870,534 A * 1/1959 Angst et al. ..... B26B 19/10 30/34.1
D191,357 S * 9/1961 Sidney et al. ..... D28/46
3,045,342 A * 7/1962 Diehl ..... B26B 21/00 30/527
3,078,569 A * 2/1963 Sidney et al. ..... B26B 21/06 30/526
3,111,757 A * 11/1963 Dubofsky ..... B26B 21/40 30/526
3,340,609 A * 9/1967 Sacharow ..... B26B 21/14 30/526
D229,795 S * 1/1974 Holohan ..... D28/46
D231,577 S * 4/1974 De Lorenzo ..... D28/46
D231,579 S * 4/1974 De Lorenzo ..... D28/46
D231,580 S * 4/1974 De Lorenzo ..... D28/46
D231,581 S * 4/1974 De Lorenzo ..... D28/46
D231,583 S * 4/1974 De Lorenzo ..... D28/46
4,392,303 A * 7/1983 Ciaffone ..... B26B 21/521 30/526
4,768,528 A * 9/1988 Steele, Jr. ..... A45D 24/36 D28/10
4,797,998 A * 1/1989 Motta ..... B26B 21/225 30/530
D310,580 S * 9/1990 King ..... D28/46
5,009,003 A * 4/1991 Grange ..... B26B 21/04 30/528
5,129,157 A * 7/1992 Wood ..... B25G 1/102 30/526
5,157,835 A * 10/1992 Lazarchik ..... B26B 21/225 30/533
5,347,717 A * 9/1994 Ts'ai ..... B26B 21/225 30/532
5,673,711 A * 10/1997 Andrews ..... A45D 24/36 30/30
5,787,593 A * 8/1998 Althaus ..... B26B 21/225 30/527
5,934,291 A * 8/1999 Andrews ..... A45D 24/36 30/526
6,018,877 A * 2/2000 Greene ..... B26B 21/222 30/298
6,029,356 A * 2/2000 Sprinkle ..... B26B 21/08 30/298
D431,095 S * 9/2000 Hyman ..... D28/45
6,164,290 A * 12/2000 Andrews ..... A45D 24/36 30/526
D446,351 S * 8/2001 Greene ..... D28/46
6,421,925 B1 * 7/2002 Wonderley ..... B26B 21/4062 30/532
6,493,950 B1 * 12/2002 Kludjian ..... B26B 21/22 30/298
6,550,148 B2 * 4/2003 Cecil ..... B26B 21/22 30/50
6,560,876 B2 * 5/2003 Carr ..... B26B 21/06 30/34.1
6,581,290 B1 * 6/2003 Fishel ..... B26B 21/222 30/526
6,615,498 B1 * 9/2003 King ..... B26B 21/225 30/527
D484,769 S * 1/2004 Cheung ..... B26B 21/527 D8/98
6,694,626 B2 * 2/2004 Kludjian ..... B26B 21/22 30/298
6,823,594 B2 * 11/2004 Kludjian ..... B26B 21/22 30/298
6,895,639 B1 * 5/2005 Bayton ..... A45F 5/00 30/298
D512,795 S * 12/2005 Carpenter ..... D28/45
7,140,115 B2 * 11/2006 Greene ..... B26B 21/40 30/526
D558,396 S * 12/2007 Sierra ..... D28/44
D612,540 S * 3/2010 Joslin ..... D28/48
7,805,845 B2 * 10/2010 Kludjian ..... B26B 21/22 30/298
D635,301 S * 3/2011 Cormier ..... D28/46
D642,740 S * 8/2011 Chiodo ..... D28/44
8,141,258 B1 * 3/2012 Frisch ..... B26B 21/527 30/298
D667,168 S * 9/2012 Greene ..... D28/48
8,607,458 B2 * 12/2013 Hosseini ..... B26B 21/446 30/526
8,707,561 B1 * 4/2014 Kneier ..... B26B 19/42 30/527
8,726,528 B2 * 5/2014 Lyles ..... B26B 19/3853 30/298
8,782,911 B1 * 7/2014 Greene ..... B26B 21/52 30/298
D717,492 S * 11/2014 Kulshreshtha ..... D28/53
D717,493 S * 11/2014 Kulshreshtha ..... D28/53
D776,876 S * 1/2017 Coviello ..... D28/48
9,643,327 B2 * 5/2017 Stevens ..... B26B 21/527
9,713,879 B2 * 7/2017 Samuels ..... B26B 21/521 30/526
D802,213 S * 11/2017 Contaldi ..... D28/48
2002/0083600 A1 * 7/2002 Donovan ..... B26B 21/14 30/526
2002/0104223 A1 * 8/2002 Oldroyd ..... B26B 21/225 30/532
2008/0072430 A1 * 3/2008 Cafaro ..... B26B 19/06 30/526
2008/0172882 A1 * 7/2008 Eger ..... B26B 21/40 30/49
2009/0277023 A1 * 11/2009 Coelho ..... B26B 21/222 30/526
2011/0283540 A1 * 11/2011 Wetteroff ..... B26B 21/523 30/47

(56) References Cited

U.S. PATENT DOCUMENTS

| | | | | |
|---|---|---|---|---|
| 2013/0061481 | A1* | 3/2013 | Cooney | B26B 21/521 30/526 |
| 2014/0026726 | A1* | 1/2014 | Griffin | B26B 21/521 30/532 |
| 2014/0068953 | A1* | 3/2014 | Wonderley | B26B 21/521 30/527 |
| 2014/0190013 | A1* | 7/2014 | Coviello | B26B 21/4081 30/47 |
| 2014/0290066 | A1* | 10/2014 | Woolfson | B26B 21/527 30/50 |
| 2015/0367522 | A1* | 12/2015 | Martin | B26B 21/527 30/526 |
| 2016/0193740 | A1* | 7/2016 | Phillips | B26B 21/527 30/34.05 |
| 2017/0274543 | A1* | 9/2017 | Quarantello | B26B 21/522 30/526 |
| 2018/0117781 | A1* | 5/2018 | Gonterman | B26B 21/527 |

FOREIGN PATENT DOCUMENTS

| | | | | | |
|---|---|---|---|---|---|
| GB | 123509 | A | * | 2/1919 | B26B 21/00 |
| GB | 631560 | A | * | 11/1949 | B26B 21/42 |
| GB | 2200587 | B | * | 8/1990 | B26B 21/06 |
| GB | 2265105 | A | * | 9/1993 | B25G 1/102 |
| JP | 05212165 | A | * | 8/1993 | |
| WO | WO 9725189 | A1 | * | 7/1997 | B26B 21/14 |
| WO | WO 2012120499 | A1 | * | 9/2012 | B26B 21/4081 |
| WO | WO 2016192743 | A1 | * | 12/2016 | B26B 21/522 |
| WO | WO 2017041120 | A1 | * | 3/2017 | B26B 21/52 |

* cited by examiner

DUAL STROKE RAZOR SYSTEM

BACKGROUND OF THE INVENTION

Field of the Invention

The present invention relates to a dual stroke razor system and more particularly pertains to a razor system adapted for holding between fingers close to the palm of a user for shaving hair of the user by a sliding forward movement and a sliding rearward movement. The holding and the shaving being done in a safe, sanitary, convenient, efficient, and economical manner.

Description of the Prior Art

The use of razor systems of known designs and configurations is known in the prior art. More specifically, razor systems of known designs and configurations previously devised and utilized for the purpose of shaving hair are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe dual stroke razor system that allows holding a razor between fingers close to the palm of a user for shaving hair of the user by a sliding forward movement and a sliding rearward movement. The holding and the shaving being done in a safe, sanitary, convenient, efficient, and economical manner.

In this respect, the dual stroke razor system according to the present invention substantially departs from the conventional concepts and designs of the prior art, and in doing so provides an apparatus primarily developed for the purpose of holding a razor between fingers close to the palm of a user for shaving hair of the user by a sliding forward movement and a sliding rearward movement. The holding and the shaving being done in a safe, sanitary, convenient, efficient, and economical manner.

Therefore, it can be appreciated that there exists a continuing need for a new and improved dual stroke razor system which can be used for holding between fingers close to the palm of a user for shaving hair of the user by a sliding forward movement and a sliding rearward movement. The holding and the shaving being done in a safe, sanitary, convenient, efficient, and economical manner. In this regard, the present invention substantially fulfills this need.

SUMMARY OF THE INVENTION

In view of the foregoing disadvantages inherent in the known types of razor systems of known designs and configurations now present in the prior art, the present invention provides an improved dual stroke razor system. As such, the general purpose of the present invention, which will be described subsequently in greater detail, is to provide a new and improved dual stroke razor system and method which has all the advantages of the prior art and none of the disadvantages.

To attain this, the present invention essentially comprises a base having a top, a bottom, a left side, a right side, an upper section, a lower section, a left lateral section extending outwardly and upwardly from the lower section, a right lateral section extending outwardly and upwardly from the lower section, a left surface along the left side section and the left lateral section, and a right surface along the right side section and the right lateral section. The left surface and the right surfaces are each in a generally semi-cylindrical configuration and together form a primary gripping assembly. A head with an operational face faces away from the base. The operational face includes at least one left blade and at least one right blade and an arcuate sliding surface there between.

As used herein, the word "left" is intended to be synonymous with "first" and the word "right" is intended to be synonymous with "second".

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dual stroke razor system which has all of the advantages of the prior art razor systems of known designs and configurations and none of the disadvantages.

It is another object of the present invention to provide a new and improved dual stroke razor system which may be easily and efficiently manufactured and marketed.

It is a further object of the present invention to provide a new and improved dual stroke razor system which is of durable and reliable construction.

An even further object of the present invention is to provide a new and improved dual stroke razor system which is susceptible of a low cost of manufacture with regard to both materials and labor, and which accordingly is then susceptible of low prices of sale to the consuming public, thereby making such dual stroke razor system economically available to the buying public.

Lastly, even still another object of the present invention is to provide a new and improved dual stroke razor system for holding between fingers close to the palm of a user for shaving hair of the user by a sliding forward movement and a sliding rearward movement. The holding and the shaving being done in a safe, sanitary, convenient, efficient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
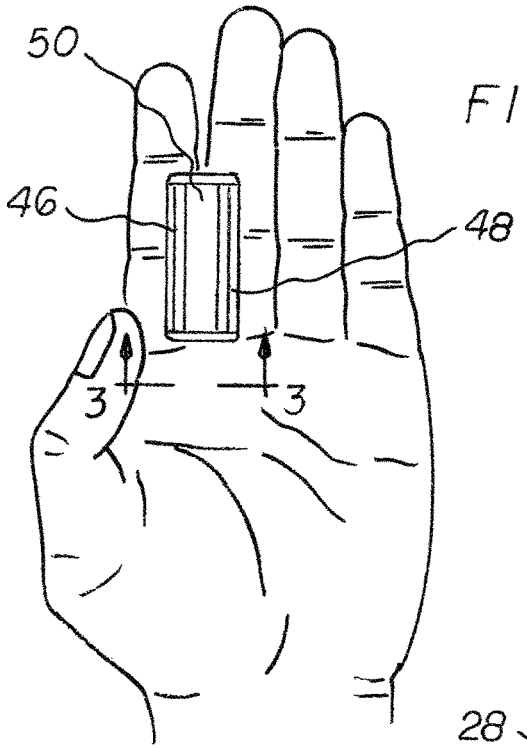
FIG. 1 is a plan view of a dual stroke razor system constructed in accordance with the principles of the present invention, the system being held for use.
Figure 2:
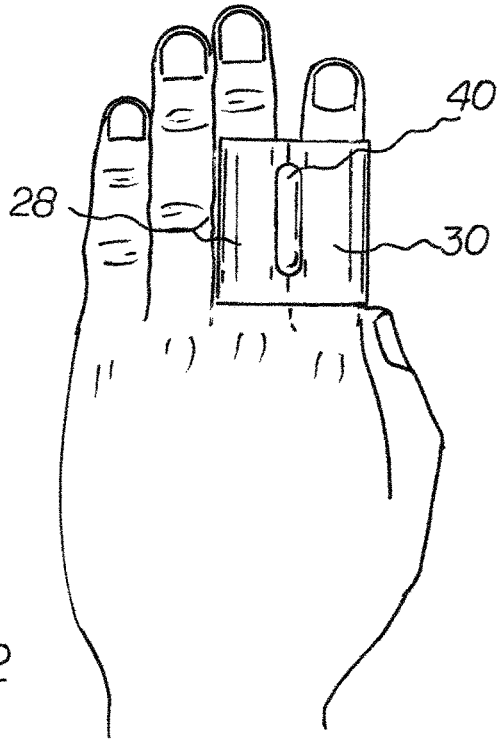
FIG. 2 is a bottom view of the system shown in FIG. 1.
Figure 3:
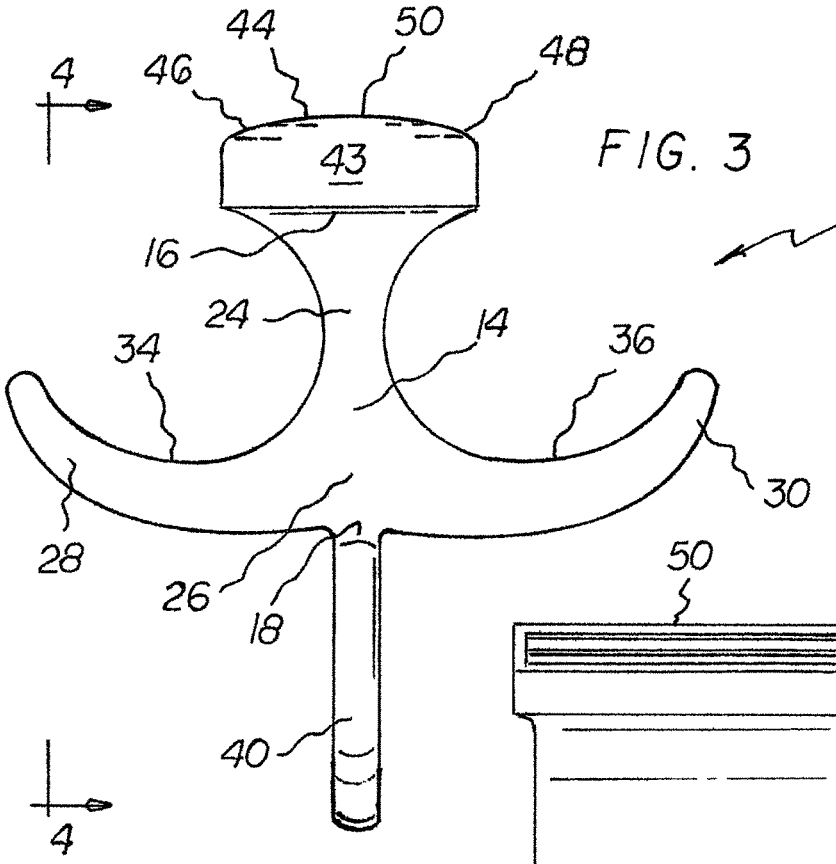
FIG. 3 is an end elevational view of the system shown in the prior Figures but not being held.
Figure 4:
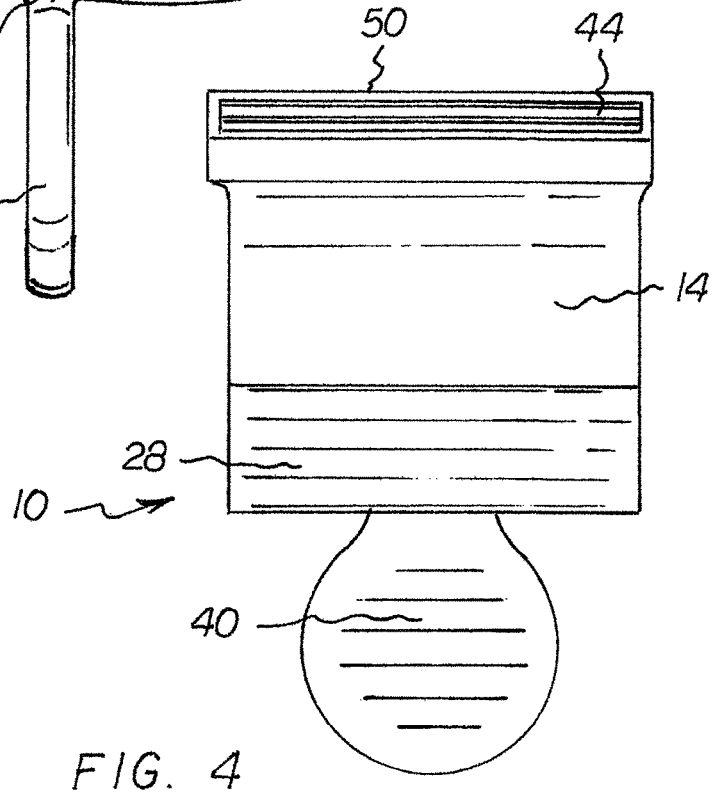
FIG. 4 is a side elevational view taken along line 4-4 of FIG. 3.

With reference now to the drawings, and in particular to FIG. 1 thereof, the preferred embodiment of the new and improved dual stroke razor system embodying the principles and concepts of the present invention and generally designated by the reference numeral 10 will be described.

The present invention, the dual stroke razor system 10 is comprised of a plurality of components. Such components in their broadest context include a base and a head. Such components are individually configured and correlated with respect to each other so as to attain the desired objective.

The dual stroke razor system 10 is adapted for holding between fingers close to the palm of a user and is adapted for shaving hair of the user by a sliding forward movement and a sliding rearward movement. The holding and the shaving being done in a safe, sanitary, convenient, efficient, and economical manner.

In the primary embodiment of the invention, as shown in FIGS. 1-4, first provided is a base 14. The base has a top 16, a bottom 18, a left side, and a right side. The base has an upper section 24 adjacent to the top. The base has a lower section 26 adjacent to the bottom. The base has a left lateral section 28 extending outwardly and upwardly from the lower section adjacent to the left side. The base has a right lateral section 30 extending outwardly and upwardly from the lower section adjacent to the right side. The base has, a left surface 34 along the left side section and the left lateral section. The base has a right surface 36 along the right side section and the right lateral section.

Next provided is a primary gripping assembly. The primary gripping assembly is formed of the left surface 34 in a semi-cylindrical configuration for 180 degrees plus or minus 20 percent with a left axis of rotation. The primary gripping assembly is also formed of the right surface 36 in a semi-cylindrical configuration for 180 degrees plus or minus 20 percent with a right axis of rotation.

Next, a secondary gripping assembly is provided. The secondary gripping assembly includes a thumb grip 40 extending downwardly from bottom of the base. The thumb grip is flat with a circular periphery. The circular periphery has a lower axis perpendicular to the left axis of rotation and the right axis of rotation.

Lastly, a head is provided. The head has an operational face 44 facing away from the base. The operational face includes a plurality of left blades 46 located over the left opening, the operational face also including a plurality of right blades 48 located over the right opening. The operational face also includes a sliding surface 50 between the left blades and the right blades. The sliding surface has a surface area. The plurality of left and right blades has a total surface area less than the surface area of the sliding surface. The left blades and the right blades are in parallel lines parallel with the left axis of rotation and the right axis of rotation. The system is adapted to be held by the user with an index finger on the left surface and a middle finger on the right surface and with the plurality of blades adjacent the palm of the user and the user moving the plurality of blades forwardly and rearwardly with respect to the left axis of rotation and the right axis of rotation. The system is also adapted to be held by the user with the middle finger and thumb on the thumb grip and the user moving the plurality of razors forwardly and rearwardly with respect to the left axis of rotation and the right axis of rotation.

Figure 5:
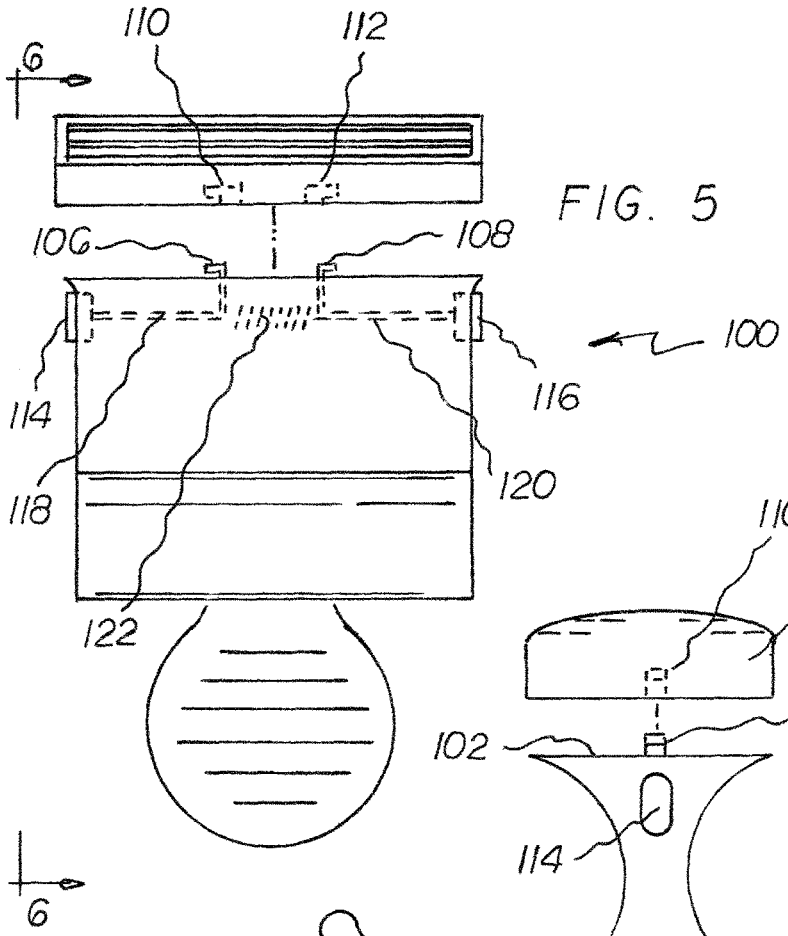
FIG. 5 is a side elevational view similar to FIG. 4 but illustrating an alternate embodiment of the invention.
Figure 6:
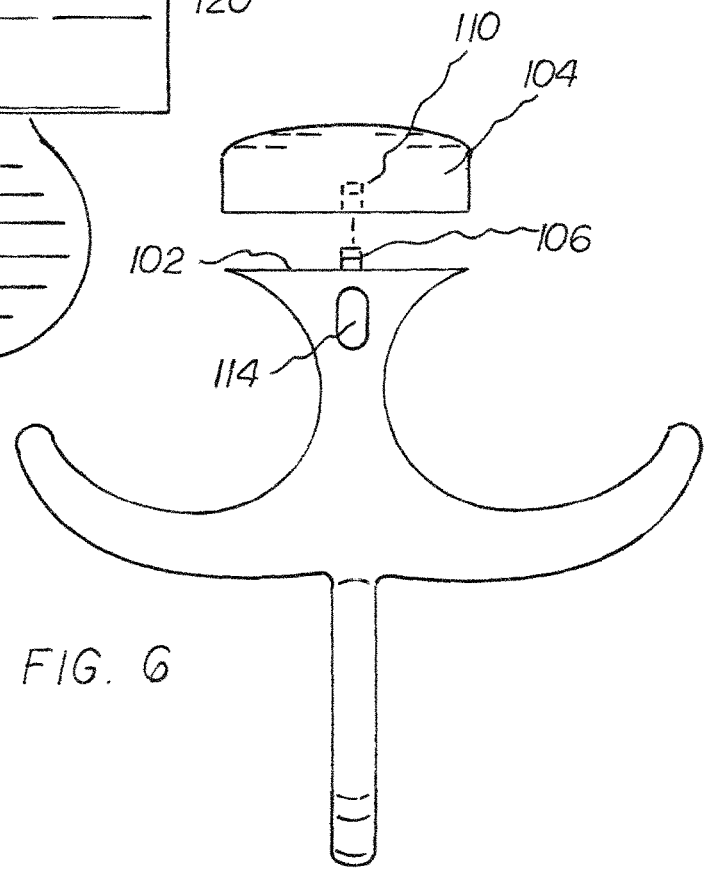
FIG. 6 is a front elevational view taken along line 6-6 of FIG. 5.

In an alternate embodiment of the system 100, as shown in FIGS. 5 and 6, the base has a flat upper surface 102 with L-shaped projections 106, 108. In this embodiment, the head 104 has L-shaped recesses 110, 112 adapted to removably receive and retain the L-shaped projections. Buttons 114, 116 are provided on the base with rods 118, 120 and a central spring 122 adapted to reciprocate the L-shaped fingers to thereby couple and uncouple the L-shaped fingers with respect to the L-shaped recesses.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A razor comprising:

a one-piece base body comprising:

a first outwardly extending lateral part having opposite first and second surfaces;

a second outwardly extending lateral part opposite the first lateral part, the second lateral part having opposite first and second surfaces;

a projection part extending outwardly from and in between the first and second lateral parts, the projection part having a first projection part surface, a second projection part surface opposite the first projection part surface, and an end;

the first projection part surface and the first surface of the first lateral part together defining a first semi-circular finger receiving surface;

the second projection part surface and the first surface of the second lateral part together defining a second semi-circular finger receiving surface;

a grip part having a first flat surface and a second flat surface, the grip part extending outwardly opposite the projection part so that a portion of the first flat surface is coincident with a portion of the second surface of the first lateral part and a portion of the second flat surface is coincident with a portion of the second surface of the second lateral part; and a head with an operation face on the end of the projection part so that the operational face faces away from the first and second lateral parts and the grip part, the operational face including at least one first blade located closer to the first semi-circular finger receiving surface than to the second semi-circular finger receiving surface, at least one second blade located closer to the second semi-circular finger receiving surface than to the first semi-circular finger receiving surface, and a sliding surface between the at least one first blade and the at least one second blade.

2. The system as set forth in claim 1 wherein:

the at least one first blade includes a plurality of first blades parallel with each other; and the at least one second blade includes a plurality of second blades parallel with each other.

3. The system as set forth in claim 1 wherein the head with the operational face is removably coupled to the end of the projection part for facilitating providing new blades to the system.

* * * * *